US012642298B2

(12) United States Patent
Li et al.

(10) Patent No.: US 12,642,298 B2
(45) Date of Patent: Jun. 2, 2026

(54) CLOSED HEAT-NOT-BURN CIGARETTE

(71) Applicant: ZHENGZHOU TOBACCO RESEARCH INSTITUTE OF CNTC, Zhengzhou City (CN)

(72) Inventors: Bin Li, Zhengzhou City (CN); Shuang Wang, Zhengzhou City (CN); Ke Zhang, Zhengzhou City (CN); Nan Deng, Zhengzhou City (CN); Le Wang, Zhengzhou City (CN); Feng Huang, Zhengzhou City (CN); Mingjian Zhang, Zhengzhou City (CN); Bing Wang, Zhengzhou City (CN)

(73) Assignee: ZHENGZHOU TOBACCO RESEARCH INSTITUTE OF CNTC (CN)

( * ) Notice: Subject to any disclaimer, the term of this patent is extended or adjusted under 35 U.S.C. 154(b) by 426 days.

(21) Appl. No.: 18/259,260

(22) PCT Filed: Dec. 25, 2020

(86) PCT No.: PCT/CN2020/139289

§ 371 (c)(1),
(2) Date: Jun. 23, 2023

(87) PCT Pub. No.: WO2022/133980

PCT Pub. Date: Jun. 30, 2022

(65) Prior Publication Data

US 2024/0049783 A1 Feb. 15, 2024

(51) Int. Cl.

| | |
|---|---|
| ***A24F 40/20*** | (2020.01) |
| ***A24F 40/46*** | (2020.01) |
| ***A24F 40/48*** | (2020.01) |

(52) U.S. Cl.

CPC ..... *A24F 40/20* (2020.01); *A24F 40/46* (2020.01); *A24F 40/48* (2020.01)

(58) Field of Classification Search
None
See application file for complete search history.

(56) References Cited

U.S. PATENT DOCUMENTS

| | | | | |
|---|---|---|---|---|
| 4,284,089 | A | 8/1981 | Ray | |
| 4,774,971 | A | 10/1988 | Vieten | |
| 2018/0014574 | A1* | 1/2018 | Rogan | A24F 40/40 |

FOREIGN PATENT DOCUMENTS

| | | | |
|---|---|---|---|
| CN | 101277622 | A | 10/2008 |
| CN | 107205496 | A | 9/2017 |

(Continued)

OTHER PUBLICATIONS

Translation of International Search Report (Year: 2021).*
International Search Report for PCT/CN2020/139289 dated May 26, 2021, 6 pages.

*Primary Examiner* — Michael J Felton
(74) *Attorney, Agent, or Firm* — FBT Gibbons LLP

(57) ABSTRACT

A closed heat-not-burn cigarette and an assembly. The assembly comprises a closed heat-not-burn cigarette (1) and a heating smoking set (2), wherein when in use, the closed heat-not-burn cigarette (1) is inserted into the heating smoking set (2) where the cigarette is heated for smoking. The closed heat-not-burn cigarette (1) comprises a tobacco rod (1-1), a hollow smoke extraction cone (1-2), a smoke transmission pipe (1-3) and a filter tip (1-4), which are sequentially connect to each other in an abutting manner and are wrapped in an external rolling connection material (1-5), at least one through hole (1-3-1) is provided in a side wall of the smoke transmission pipe (1-3), and the through hole (1-3-1) penetrates the external rolling connection material (1-5); the heating smoking set (2) comprises a heating section (2-1), a cap (2-3) and a sealing ring (2-2), the heating section (2-1) being internally provided with a cigarette accommodating cavity (2-1-1) and a heating element (2-1-

(Continued)

2), and the inner cavity of the cap (2-3) being of a gradually-expanded structure. Air does not flow through a tobacco section, thereby reducing the oxygen content of the tobacco section; a closed structured is used, thereby preventing tobacco residues from falling off; and aroma components in the tobacco are released more fully, such that the taste is closer to that of traditional tobaccos.

10 Claims, 4 Drawing Sheets

(56) References Cited

FOREIGN PATENT DOCUMENTS

| | | | |
|---|---|---|---|
| CN | 111567862 | A | 8/2020 |
| CN | 111567863 | A | 8/2020 |
| CN | 111588079 | A | 8/2020 |
| CN | 111588089 | A | 8/2020 |
| EP | 3733002 | A1 | 11/2020 |

* cited by examiner

CLOSED HEAT-NOT-BURN CIGARETTE

CROSS-REFERENCE TO RELATED APPLICATION(S)

This application is a U.S. National Phase Patent Application of International Application Number PCT/CN2020/139289, filed on Dec. 25, 2020, the entire content of which is incorporated herein by reference.

FIELD OF THE INVENTION

The present invention belongs to the field of heat-not-burn tobacco products, and in particular, to a closed heat-not-burn cigarette and an assembly thereof.

BACKGROUND OF THE INVENTION

Traditional tobacco has a history for hundreds of years and has been integrated into the lives of most smokers. In recent years, along with the improvement of the people's living standard, issues such as smoking and health, harm of second-hand smoke and the like are more and more emphasized by people, and the harm brought by the traditional tobacco products is becoming increasingly prominent. Meanwhile, with the implementation of WHO's "Framework Convention on Tobacco Control", especially the gradual expansion of smoking bans in public places around the world, the development environment of tobacco products has undergone significant and profound changes, and the structure of tobacco products is moving towards diversification and smoke-free development (Xiaobing Cheng, Baojiang Li, Yandong Han. The Development Status of New Tobacco in the World [J]. China Tobacco, 2014 (3): 38.). New tobacco products have gradually become a realistic choice for major multinational tobacco companies to cope with the declining sales of traditional tobacco products (Yali Liu, Jinbang Wang, Xinzhang Zhao, et al. Development Status and the Prospect of Heat-not-burn Tobacco Products [J]. Chinese Journal of Tobacco, 2018, 24 (4)).

At present, most of the heat-not-burn cigarettes adopt air as a carrier of smoke, in order to ensure that the tobacco is not burned, the applied heating temperature is usually lower and generally does not exceed 300° C., compared with the traditional cigarette, the aroma components of the novel heat-not-burn cigarette are difficult to completely release, and the smoke quantity is insufficient, so that the cigarette is difficult to be accepted by traditional smokers. In addition, in order to ensure air circulation, the tobacco ends of the most of heat-not-burn cigarettes have an open structure, that is to say, tobacco shreds or reconstituted tobacco strips are directly exposed to the outside or connected with the external atmosphere through a certain airflow channel, and in the process of pulling out the cigarettes, tobacco residues will fall off, which is easy to cause pollution to the smoking sets, so that such type of tobacco needs time to spend time cleaning the smoking sets after a period of use.

If a closed cigarette structure is adopted, the oxygen content is decreased along with the heating process (due to the replacement effect of fresh smoke on the internal atmosphere). At this moment, even if the heating temperature is increased, the combustion phenomenon will not occur, and at meanwhile, the situation that the tobacco residues fall off so as to pollute the smoking set will be occurred. However, because there is no carrier airflow flowing through the tobacco, closed cigarette smoke migration will become difficult.

The Coanda effect, also known as the Coanda effect or the wall effect, refers to the tendency of fluid flow or airflow to leave the original flow direction to flow with the protruding surface due to surface friction when the fluid flows through the surface of the object. The Venturi phenomenon refers to the low pressure generated near the high-speed flowing fluid, resulting in adsorption. Using the Coanda effect, the air entering the small hole can flow along the surface of the hollow smoke extraction cone. Due to the existence of the Venturi phenomenon, the gas flowing at a high speed along the surface of the extraction cone will form a negative pressure area at the opening of the extraction cone. Using the Coanda effect and the Venturi phenomenon, the concentration difference and the pressure difference can be formed inside and outside the closed tobacco section, and then the fresh smoke generated by the tobacco section can be extracted by utilizing the active diffusion of the gas.

SUMMARY OF THE INVENTION

The purpose of the present invention is to invent a closed heat-not-burn cigarette and the assembly thereof in view of the problems existing in the vast majority of heat-not-burn cigarettes proposed in the above background.

A closed heat-not-burn cigarette comprises a tobacco rod, a hollow smoke extraction cone, a smoke transmission pipe, a functional filter tip and an external rolling connection material. Wherein the tobacco rod, the hollow smoke extraction cone, the smoke transmission pipe and the functional filter tip are sequentially connected to each other in an abutting manner and wrapped by the external rolling connection material.

The circumference and/or the upstream end surface of the tobacco rod are/is wrapped by a paper-based material or a foil-based material with air impermeability or controllable air permeability to form a closed structure.

The hollow smoke extraction cone comprises a cylindrical base and a tapered cone and is provided with a tapered cavity; the tapered cone is provided with a taper hole on the top and/or the side wall of the tapered cone.

The circumferential side wall of the smoke transmission pipe is provided with at least one through hole and penetrates through the external rolling connection material. Preferably, the axial distance from the through hole to the bottom surface of the cone is smaller than the axial distance from the taper hole to the bottom surface of the tapered cone;

A plug-in sealing structure is arranged between the hollow smoke extraction cone and the smoke transmission pipe.

Preferably, the tobacco rod comprises tobacco shreds, tobacco sheets, tobacco particles, tobacco extrusion forms or tobacco-containing gels.

The external rolling connection material can be either common cigarette paper, tipping paper, or a heat-resistant and air-impermeable thin material, such as Polytetrafluoroethylene (PTFE), Polyetheretherketone (PEEK) resin, and silica gel.

The number of the through holes on the smoke transmission pipe is inversely proportional to the aperture thereof.

A closed heat-not-burn cigarette assembly comprises the closed heat-not-burn cigarette and a closed heating smoking set.

The closed heating smoking set comprises a heating section, and the heating section comprises a cigarette accommodating cavity.

Heating elements are provided at the circumferential side wall and/or the bottom surface within the cigarette accommodating cavity, and characterized in that when the closed heat-not-burn cigarette is inserted, the tobacco rod is partially or completely wrapped by the circumferential side wall within the cigarette accommodating cavity.

The closed heating smoking set further comprises a cap, the cap and the heating section are directly detachably connected with each other or detachably connected through a sealing ring, and the cap is provided with a gradually-expanded inner cavity.

The gradually-expanded inner cavity of the cap is in a truncated conical shape, the conical apex angle of the gradually-expanded inner cavity is not more than 10 degrees, and the end of the cap with a smaller inner diameter is directly or indirectly detachably connected with the heating section.

The use mode or the process of the invention is as follows: firstly, removing the cap of the heating smoking set, inserting the closed heat-not-burn cigarette, then installing the cap back and locking it, and starting the heating while the cap is locked. During suction, air firstly enters a space between the cap and a cigarette, then enters the smoke transmission pipe through the through hole on the smoke transmission pipe of the closed heat-not-burn cigarette and is sprayed onto the surface of the extraction cone. Due to the Venturi effect and the Coanda effect, a negative pressure is formed at the taper hole, and a positive pressure is established on the tobacco rod portion by heating the tobacco rod; the existence of the pressure differences between the positive and negative pressure as well as the smoke concentration difference thereof can lead to the active diffusion of smoke, so that the smoke flows out of the taper hole and enters the mouth through the inner cavity of the smoke transmission pipe and the filter tip. The smoke transmission pipe has the dual functions of smoke extraction and smoke cooling. The smoking resistance of the cigarette can be adjusted by changing the diameter and the position of the through hole on the wall of the smoke extraction cavity (namely the smoke transmission pipe) of the closed heat-not-burn cigarette.

The advantages of the present invention are as follows: 1. air does not flow through the tobacco section, so that the oxygen content of the tobacco section can be reduced, and the heating temperature can be greatly increased; 2. By adopting a sealed (closed) structure, there will no tobacco residue falls\ off, and there is no need to clean the smoking set frequently; 3. the release of aroma components in the tobacco is more sufficient, easy to release continuously, and the taste is closer to that of the traditional tobacco, which is easier to be accepted by traditional smokers.

BRIEF DESCRIPTION OF THE DRAWINGS

In FIGS. 5 and 6: 1-2-1 a cylindrical base, 1-2-2 a cone, 1-2-2-1 a taper hole, and 1-2-3 a tapered cavity.

In FIGS. 7 and 8: 2-1 a heating section, 2-1-1 a cigarette accommodating cavity, 2-1-2 a heating element; 2-2 a sealing ring, 2-3 a cap, 2-3-1 a gradually-expanded inner cavity.

DETAILED DESCRIPTION OF THE EMBODIMENTS

The present invention will further describes the closed heat-not-burn cigarette and assembly thereof in conjunction with the accompanying drawings:

Example 1

Figure 4:
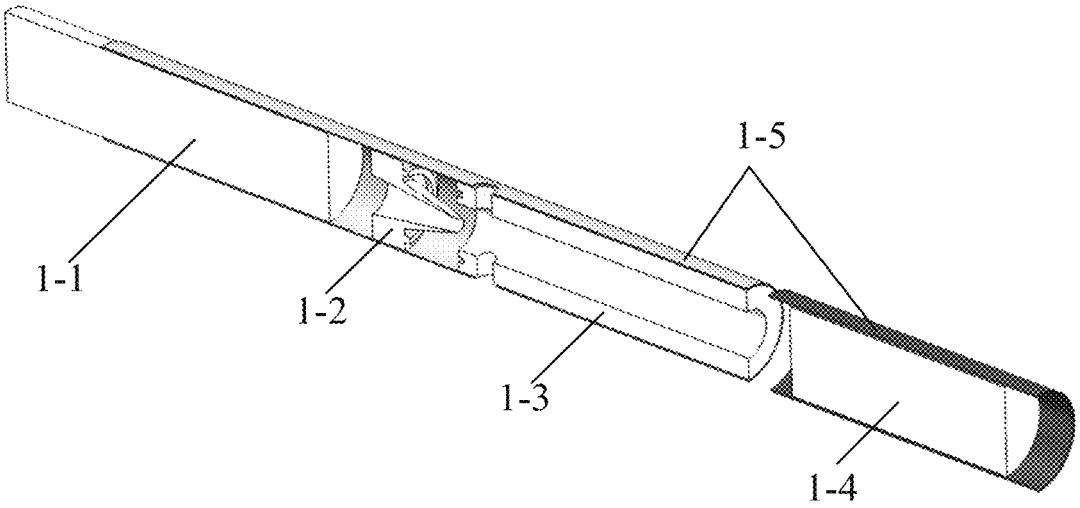
FIG. 4 is an exploded view of a closed heat-not-burn cigarette to be assembled In FIGS. 3 and 4: 1-1, a tobacco rod; 1-2 an extraction cone, 1-2-1 a cylindrical base, 1-2-2 a cone, 1-2-2-1 a taper hole, 1-2-3 a tapered cavity; 1-3 a smoke transmission pipe, 1-4 a filter tip, 1-5 an external rolling connection material.
Figure 5:
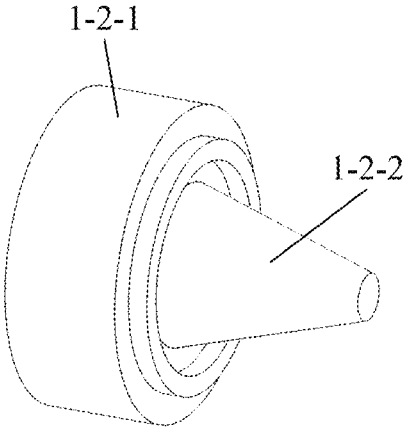
FIG. 5 is a schematic view of a hollow smoke extraction cone.
Figure 6:
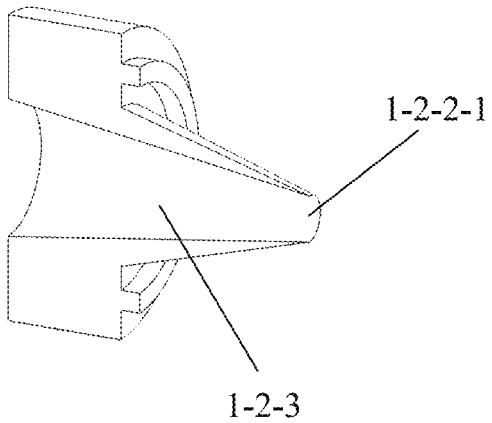
FIG. 6 is an axial cross-sectional view of a hollow smoke extraction cone.

A closed heat-not-burn cigarette comprises a tobacco rod (1-1), a hollow smoke extraction cone (1-2), a smoke transmission pipe (1-3), a functional filter tip (1-4) and an external rolling connection material (1-5). Wherein the tobacco rod (1-1), the hollow smoke extraction cone (1-2), the smoke transmission pipe (1-3) and the functional filter tip (1-4) are connected to each other in an abutting manner in sequence and are wrapped by an external rolling connection material (1-5) (as shown in FIG. 4).

The circumference and/or the upstream end surface of the tobacco rod (1-1) are/is wrapped by a paper-based material or a foil-based material with air impermeability or controllable air permeability to form a closed structure.

Figure 3:
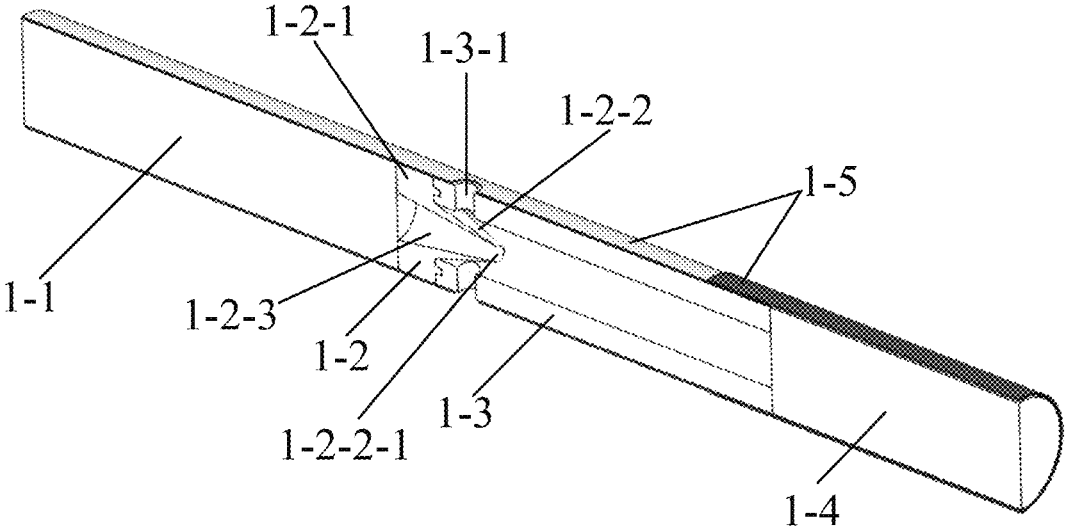
FIG. 3 is an axial cross-sectional view of a closed heat-not-burn cigarette.

The hollow smoke extraction cone (1-2) comprises a cylindrical base (1-2-1) and a tapered cone (1-2-2), and is provided with a tapered cavity (1-2-3) (as shown in FIG. 3); the tapered cone (1-2-2) is provided with a taper hole (1-2-2-1) on the top and/or the side wall of the tapered cone (as shown in FIGS. 3, 5, 6 and 9).

The circumferential side wall of the smoke transmission pipe (1-3) is provided with at least one through hole (1-3-1) which penetrates through the external rolling connection material (1-5). Preferably, the axial distance of the through hole (1-3-1) from the bottom surface of the tapered cone (1-2-2) is smaller than the axial distance of the taper hole (1-2-2-1) from the bottom surface of the tapered cone (1-2-2) (as shown in FIG. 3).

A plug-in sealing structure is arranged between the hollow smoke extraction cone (1-2) and the smoke transmission pipe (1-3).

Preferably, the tobacco rod (1-1) is a traditional tobacco or reconstituted tobacco sheet base.

The external rolling connection material (1-5) may be either ordinary cigarette paper or tipping paper.

When packing the cigarette, the tobacco rod, the extraction cone and the smoke transmission pipe are first wrapped and connected together through the cigarette paper, and then wrapped and connected with the filter tip together through the tipping paper.

The extraction cone and the smoke transmission pipe are sealed and connected with each other by a boss and a slot which are machined on the base of the extraction cone and the end surface of the smoke transmission pipe.

The ratio between the length of the cone and the length of the smoke transmission pipe is in the range from 1:3 to 1:6, preferably 1:4. The shape of the smoke extraction cone can be a standard cone, and also can be a non-standard cone with a concave or convex surface.

Example 2

A closed heat-not-burn cigarette assembly comprises the closed heat-not-burn cigarette and a closed heating smoking set (2).

Figure 7:
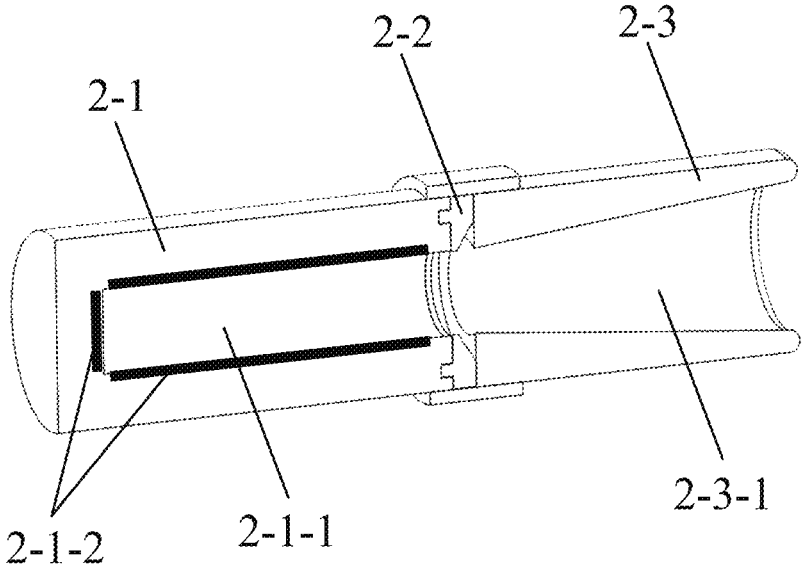
FIG. 7 is an axial cross-sectional view of a heating smoke set.
Figure 8:
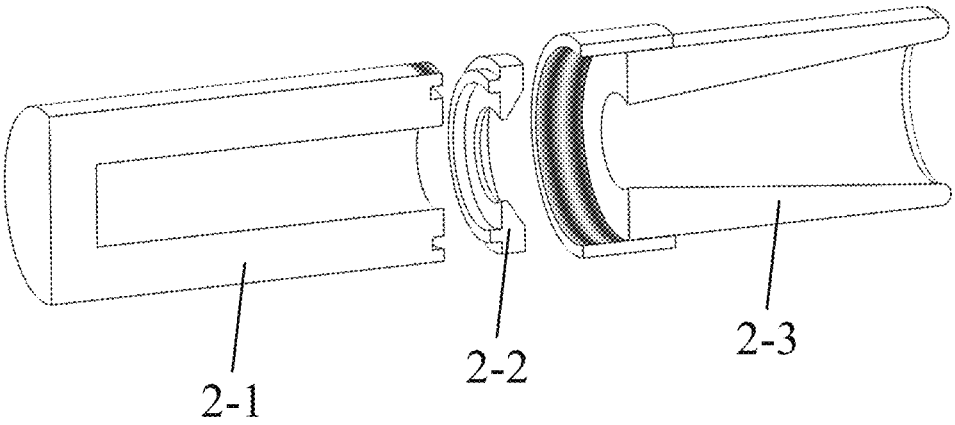
FIG. 8 is an exploded view of the heating smoke set to be assembled.
Figure 9:
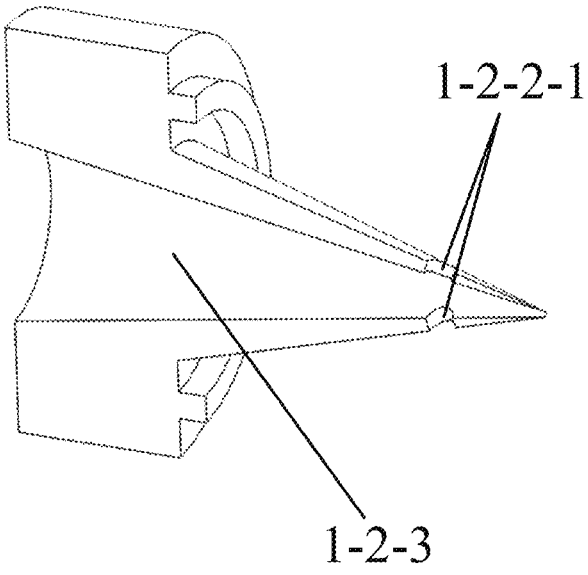
FIG. 9 is an axial cross-sectional view of the hollow smoke extraction cone (with a taper hole opened on a side wall of the cone), In the FIG. 9: 1-2-2-1, a taper hole, 1-2-3 a tapered cavity.

The closed heating smoking set (2) comprises a heating section (2-1), and the heating section (2-1) comprises a cigarette accommodating cavity (2-1-1) (as shown in FIG. 7 and FIG. 8).

Heating elements (2-1-2) are arranged on the circumferential side wall and/or the bottom surface within the cigarette accommodating cavity (2-1-1) (as shown in FIG. 7), and when the closed heat-not-burn cigarette is inserted, the tobacco rod is completely wrapped by the circumference of within the cigarette accommodating cavity.

The closed heating smoking set (2) further comprises a cap (2-3), the cap (2-3) and the heating section (2-1) are directly detachably connected with each other or detachably connected with each other through a sealing ring (2-2), and the cap (2-3) is provided with a gradually-expanded inner cavity (2-3-1) (as shown in FIG. 7).

The gradually-expanded inner cavity (2-3-1) of the cap (2-3) has a truncated conical shape, the conical apex angle thereof is not more than 10 degrees, and the end of the cap (2-3) with smaller inner diameter is directly or indirectly detachably connected with the heating section (2-1).

The heating section, the sealing ring and the cap are coaxial, and the cap is connected with the heating section through threads.

The sealing ring can be embedded on the heating section through a groove machined on the end surface of the heating section.

The heating method of the heating section is electric heating.

Example 3

Figure 1:
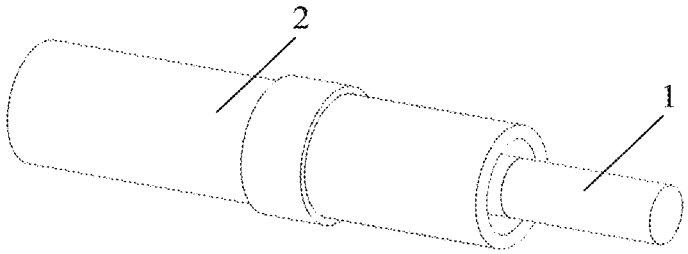
FIG. 1 is a schematic view of the overall structure of a closed heat-not-burn cigarette assembly.
Figure 2:
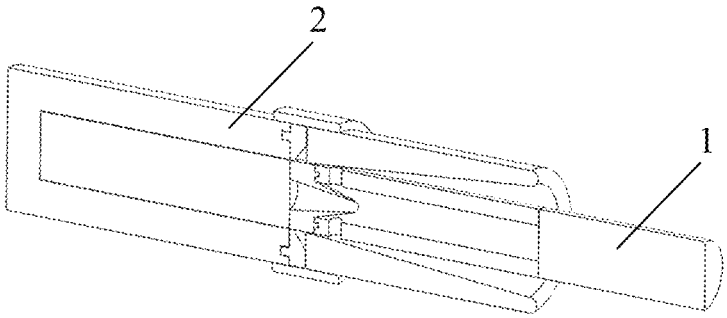
FIG. 2 is an axial cross-sectional view of a closed heat-not-burn cigarette assembly, In FIGS. 1 and 2: 1. a closed heat-not-burn cigarette, 2, a heating smoking set.

The using mode of the present invention is shown in FIGS. 1 and 2, and the specific process is as follows: first, removing the cap of the heating smoking set cap, inserting the closed heat-not-burn cigarette, then installing the cap back and locking it, and starting the heating while the cap is locked. During suction, air firstly enters a space between the cap and the cigarette, then enters the inside of the smoke transmission pipe through the through hole on the smoke transmission pipe of the closed heat-not-burn cigarette and is sprayed onto the surface of the extraction cone. Due to the Venturi effect and the Coanda effect, a negative pressure is formed at the taper hole; and heating the tobacco rod may establishes a positive pressure on the tobacco rod portion; the existence of the pressure differences between the positive pressure and the negative pressure as well as the smoke concentration difference may lead to the active diffusion of smoke, so that the smoke flows out of the taper hole and enters the mouth through the inner cavity of the smoke transmission pipe and the filter tip.

The smoke transmission pipe has the dual functions of smoke extraction and smoke cooling. The smoking resistance of the cigarette can be adjusted by changing the diameter and the position of the through hole on the wall of the smoke extraction cavity (namely, smoke transmission pipe)) of the closed heat-not-burn cigarette.

What is claimed is:

1. A closed heat-not-burn cigarette, characterized in that: said closed heat-not-burn cigarette comprises a tobacco rod, a hollow smoke extraction cone, a smoke transmission pipe, a functional filter tip and an external rolling connection material;

said tobacco rod, said hollow smoke extraction cone, said smoke transmission pipe, and said functional filter tip are sequentially connected to each other in an abutting manner and wrapped by said external rolling connection material;

a circumference and/or an upstream end surface of the tobacco rod are/is wrapped by a paper-based material or a foil-based material with air impermeability or controllable air permeability to form a closed structure;

said hollow smoke extraction cone comprises a cylindrical base and a tapered cone, and is provided with a tapered cavity; said tapered cone is provided with a taper hole on the top and/or the side wall thereof, and the number of the taper holes is at least one;

a circumferential side wall of the smoke transmission pipe is provided with at least one through hole which penetrates through the external rolling connection material, and an axial distance from the at least one through hole to a bottom surface of the cone is smaller than an axial distance from the taper hole to the bottom surface of the tapered cone; and a plug-in sealing structure is arranged between the hollow smoke extraction cone and the smoke transmission pipe.

2. The closed heat-not-burn cigarette according to claim 1, characterized in that said tobacco rod comprises tobacco shreds, tobacco sheets, tobacco particles, tobacco extrusion forms or tobacco-containing gels.

3. The closed heat-not-burn cigarette according to claim 1, characterized in that the external rolling connection material comprises ordinary cigarette paper, tipping paper, or a heat-resistant and air-impermeable thin material.

4. The closed heat-not-burn cigarette according to claim 1, characterized in that an aperture of the at least one through hole on the smoke transmission pipe is inversely proportional to the number of through holes.

5. A closed heat-not-burn cigarette assembly characterized in that said closed heat-not-burn cigarette assembly comprises the closed heat-not-burn cigarette according to claim 1 and a closed heating smoking set.

6. The closed heat-not-burn cigarette assembly according to claim 5, characterized in that the closed heating smoking set comprises a heating section, and said heating section comprises a cigarette accommodating cavity.

7. The closed heat-not-burn cigarette assembly according to claim 5, characterized in that the closed heating smoking set further comprises a cap, the cap and the heating section are detachably connected to each other directly or by a sealing ring, and the cap has a gradually-expanded inner cavity.

8. The closed heat-not-burn cigarette assembly according to claim 6, characterized in that heating elements are provided at a circumferential side wall and/or a bottom surface within the cigarette accommodating cavity, and characterized in that when said closed heat-not-burn cigarette is inserted, the tobacco rod thereof is partially or completely wrapped by the circumferential side wall within the cigarette accommodating cavity.

9. The closed heat-not-burn cigarette assembly according to claim 7, characterized in that the gradually-expanded inner cavity of the cap has a truncated conical shape, the conical apex angle thereof is not more than 10 degrees, and an end of the cap with a smaller inner diameter is directly or indirectly detachably connected with the heating section.

10. The closed heat-not-burn cigarette assembly according to claim 3, characterized in that the external rolling connection material comprises Polytetrafluoroethylene (PTFE), Polyetheretherketone (PEEK) resin, or silica gel.

* * * * *